US010731658B2

(12) United States Patent
Inouchi et al.

(10) Patent No.: US 10,731,658 B2
(45) Date of Patent: Aug. 4, 2020

(54) AXIAL FAN

(71) Applicant: Nidec Corporation, Kyoto (JP)

(72) Inventors: Kazuhiro Inouchi, Kyoto (JP); Junya Matsuyama, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 142 days.

(21) Appl. No.: 15/937,975

(22) Filed: Mar. 28, 2018

(65) Prior Publication Data

US 2019/0093669 A1 Mar. 28, 2019

(30) Foreign Application Priority Data

Sep. 28, 2017 (JP) ..... 2017-187682

(51) Int. Cl.
*F04D 29/38* (2006.01)
*F04D 19/00* (2006.01)
(Continued)

(52) U.S. Cl.
CPC ..... *F04D 29/384* (2013.01); *F04D 19/002* (2013.01); *F04D 25/0613* (2013.01);
(Continued)

(58) Field of Classification Search
None
See application file for complete search history.

(56) References Cited

U.S. PATENT DOCUMENTS 2,811,303 A * 10/1957 Ault ..... F04D 29/325 416/223 R
3,144,201 A * 8/1964 Rundle ..... F04D 29/324 415/194
(Continued)

FOREIGN PATENT DOCUMENTS

JP 2005-076473 A 3/2005
JP 2008-245344 A 10/2008
(Continued)

OTHER PUBLICATIONS

Inouchi et al., "Axial Fan," U.S. Appl. No. 15/937,978, filed Mar. 28, 2018.
(Continued)

*Primary Examiner* — Christopher Verdier
*Assistant Examiner* — Juan G Flores
(74) *Attorney, Agent, or Firm* — Keating & Bennett

(57) ABSTRACT

An axial fan includes a motor, an impeller, and a housing including a tubular air channel wall portion. The impeller includes a tubular impeller hub, and arranged in a circumferential direction on the impeller hub. Each blade includes a first portion where all of an inner circumferential developed blade, an outer circumferential developed blade, and an intermediate circumferential developed blade superimposed on each other overlap. The inner circumferential developed blade is a junction of the blade with the outer surface of the impeller hub. The outer circumferential developed blade is a radially outermost portion. The intermediate circumferential developed blade is a radially intermediate portion of the blade between the junction and the radially outermost portion. The radially outermost portion is at the shortest radial distance from the air channel wall portion in at least a portion of the first portion.

10 Claims, 16 Drawing Sheets

(51) Int. Cl.

| | |
|---|---|
| ***F04D 29/54*** | (2006.01) |
| ***F04D 25/08*** | (2006.01) |
| ***F04D 29/32*** | (2006.01) |
| ***F04D 25/06*** | (2006.01) |
| ***F04D 29/26*** | (2006.01) |

(52) U.S. Cl.
CPC ..... *F04D 25/08* (2013.01); *F04D 29/263* (2013.01); *F04D 29/329* (2013.01); *F04D 29/545* (2013.01); *F04D 25/06* (2013.01)

(56) References Cited

U.S. PATENT DOCUMENTS

| | | | | |
|---|---|---|---|---|
| 6,499,948 | B1 * | 12/2002 | Iyer | F04D 29/545 415/220 |
| 7,029,229 | B2 | 4/2006 | Iwase et al. | |
| 9,822,801 | B2 | 11/2017 | Nakagawa et al. | |
| 2014/0241894 | A1 * | 8/2014 | Brownell | F04D 29/329 416/223 R |
| 2016/0281739 | A1 | 9/2016 | Nakagawa et al. | |

FOREIGN PATENT DOCUMENTS

| | | | |
|---|---|---|---|
| JP | 2014-047711 | A | 3/2014 |
| JP | 2014-231747 | A | 12/2014 |
| WO | 2015/049914 | A1 | 4/2015 |

OTHER PUBLICATIONS

Inouchi et al., "Axial Fan," U.S. Appl. No. 15/937,981, filed Mar. 28, 2018.
Inouchi et al., "Axial Fan," U.S. Appl. No. 15/937,982, filed Mar. 28, 2018.

* cited by examiner

AXIAL FAN

CROSS REFERENCE TO RELATED APPLICATIONS

This application claims the benefit of priority to Japanese Patent Application No. 2017-187682 filed on Sep. 28, 2017. The entire contents of this application are hereby incorporated herein by reference.

BACKGROUND OF THE INVENTION

1. Field of the Invention

The present disclosure relates to an axial fan.

2. Description of the Related Art

A known blower apparatus includes a bell mouth portion arranged radially outside of a propeller fan, and a diffuser portion arranged continuously with a downstream end of the bell mouth portion. In addition, at least a portion of an inner surface of the diffuser portion is defined by a slanting surface extending radially outward while extending in a downstream direction, and an opening of the diffuser portion at a downstream end thereof is arranged to have a noncircular shape.

The noncircular shape of the opening of the diffuser portion at the downstream end leads to a reduced loss and an improved pressure recovery effect.

SUMMARY OF THE INVENTION

However, when the opening of the diffuser portion at the downstream end has a noncircular shape, a deformation of the propeller fan caused by a centrifugal force or the like might result in a failure for a clearance space between the inner surface of the diffuser portion and the propeller fan to be optimal, resulting in reduced air blowing efficiency.

An axial fan according to a preferred embodiment of the present disclosure includes a motor including a shaft arranged to extend along a central axis extending in a vertical direction; an impeller fixed to the shaft, and arranged to be capable of rotating about the central axis; and a housing including an air channel wall portion being tubular, extending in an axial direction, and arranged radially outside of the impeller. The impeller includes a tubular impeller hub directly or indirectly fixed to the shaft, and a plurality of blades arranged in a circumferential direction on an outer surface of the impeller hub. Each blade includes a first portion where all of an inner circumferential developed blade, an outer circumferential developed blade, and an intermediate circumferential developed blade superimposed on each other overlap when viewed in a radial direction, the inner circumferential developed blade being a circumferential development of a junction of the blade with the outer surface of the impeller hub, the outer circumferential developed blade being a circumferential development of a radially outermost portion of the blade, the intermediate circumferential developed blade being a circumferential development of a radially intermediate portion of the blade between the junction and the radially outermost portion of the blade. The radially outermost portion of the blade is at a shortest radial distance from an inner surface of the air channel wall portion in at least a portion of the first portion.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present disclosure will be described in detail with reference to the accompanying drawings. It is assumed herein that, regarding an axial fan A, a direction parallel to a central axis C1 of the axial fan A is referred to by the term "axial direction", "axial", or "axially", that directions perpendicular to the central axis C1 of the axial fan A are each referred to by the term "radial direction", "radial", or "radially", and that a direction along a circular arc centered on the central axis C1 of the axial fan A is referred to by the term "circumferential direction", "circumferential", or "circumferentially". It is also assumed herein that, regarding the axial fan A, an axial direction is a vertical direction, and that a side on which an air inlet 16 of a housing 10 is arranged with respect to an impeller 40 is defined as an upper side. The shape of each member or portion and relative positions of different members or portions will be described based on the above assumptions. It should be noted, however, that the above definition of the vertical direction and the upper and lower sides is made simply for the sake of convenience in description, and is not meant to restrict relative positions or directions of different members or portions of the axial fan A when in use. It is also assumed herein that an upstream side and a downstream side are defined with respect to a direction in which an air flow caused by rotation of the impeller 40 passes.

Figure 1:
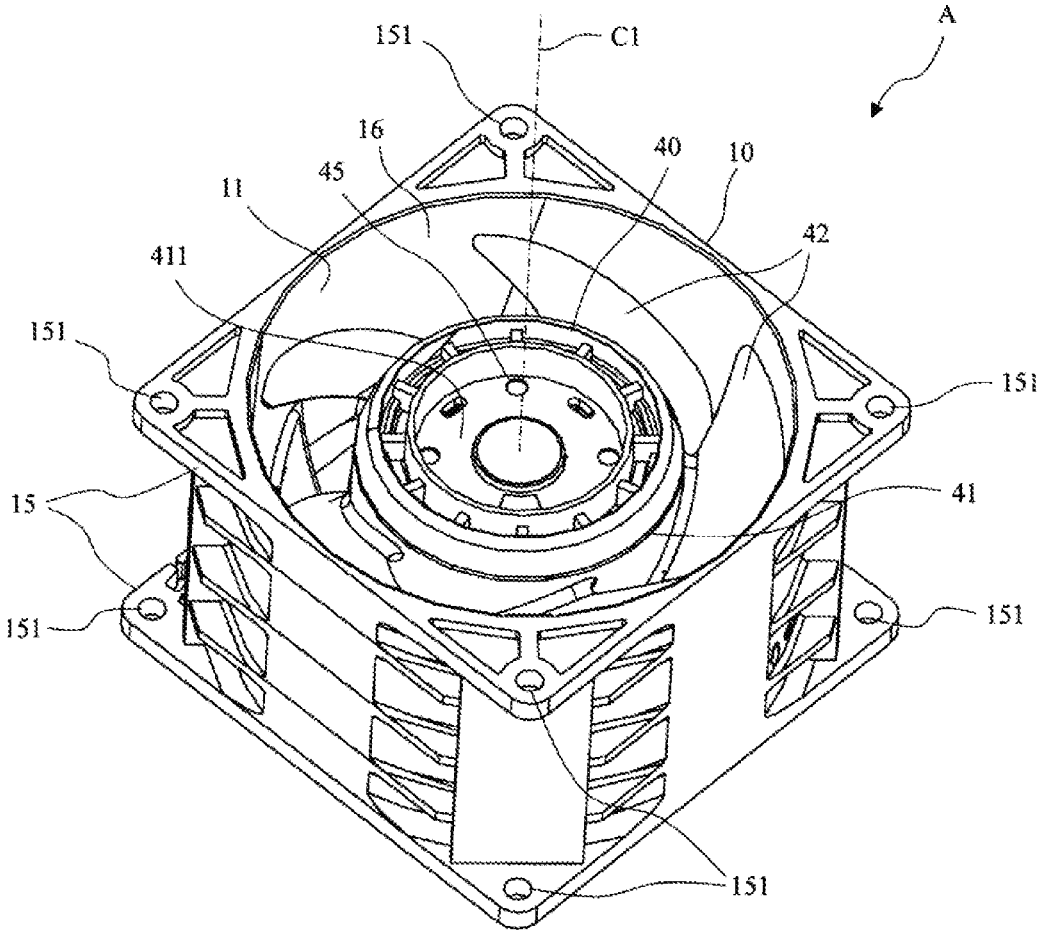
FIG. 1 is a perspective view illustrating an axial fan according to a preferred embodiment of the present disclosure.
Figure 2:
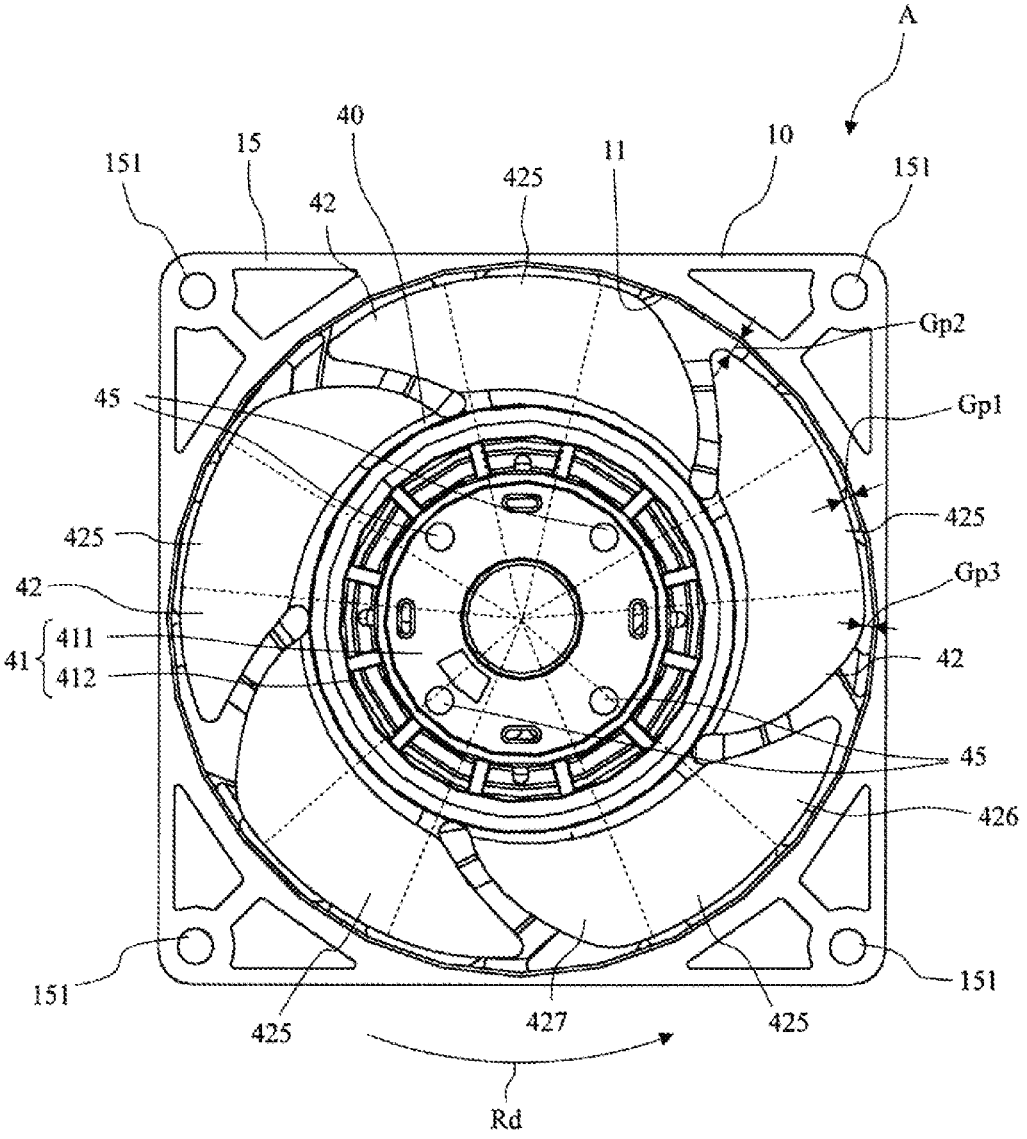
FIG. 2 is a plan view of the axial fan illustrated in FIG. 1.
Figure 3:
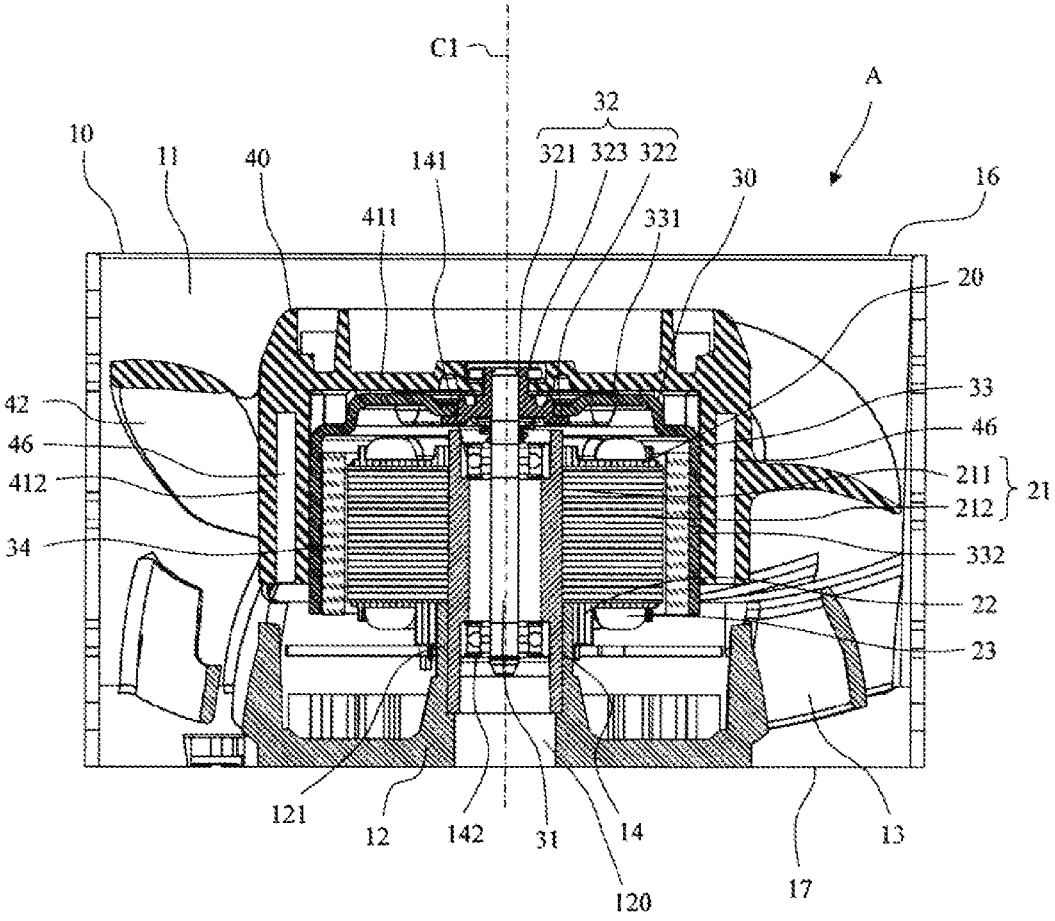
FIG. 3 is a vertical sectional view of the axial fan illustrated in FIG. 1.

FIG. 1 is a perspective view illustrating an axial fan A according to a first preferred embodiment of the present disclosure. FIG. 2 is a plan view of the axial fan A illustrated in FIG. 1. FIG. 3 is a vertical sectional view of the axial fan A illustrated in FIG. 1.

Referring to FIGS. 1 to 3, the axial fan A according to the present preferred embodiment includes a housing 10, a stator portion 20, a rotor portion 30, and an impeller 40. The stator portion 20 is fixed to the housing 10. The rotor portion 30 is arranged to be capable of rotating with respect to the stator portion 20, and includes a portion arranged radially outside of the stator portion 20 with a gap therebetween. The impeller 40 is attached to the rotor portion 30.

Figure 4:
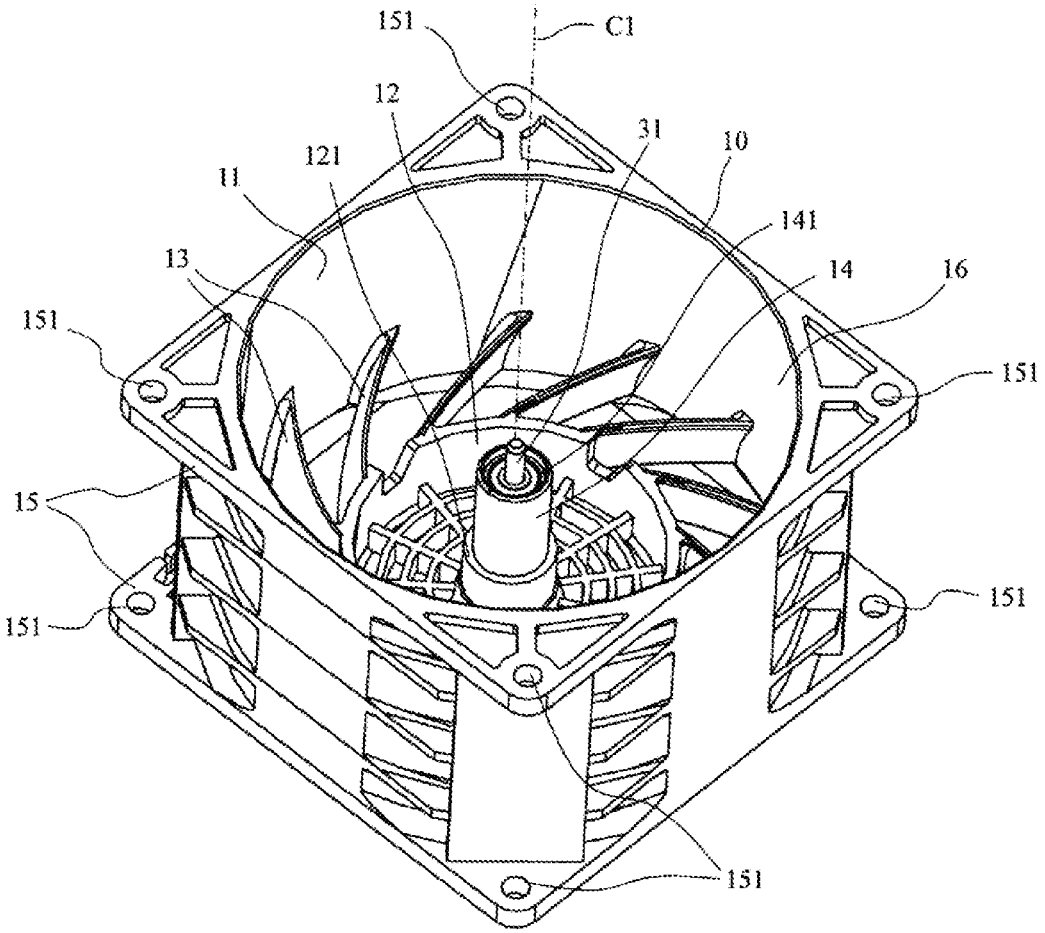
FIG. 4 is a perspective view of a housing according to a preferred embodiment of the present disclosure.

The housing 10 will now be described below with additional reference to FIG. 4. FIG. 4 is a perspective view of the housing 10. In the perspective view illustrated in FIG. 4, a shaft 31, which will be described below, of the rotor portion 30 is also depicted.

The housing 10 includes an air channel wall portion 11, a base portion 12, stationary vanes 13, a bearing holding tube portion 14, and flange portions 15. The air channel wall portion 11 is tubular, extending in the axial direction, and is arranged radially outside of the impeller 40. The air channel wall portion 11 includes a cylindrical inner surface arranged to extend along the central axis C1. The impeller 40 is arranged to rotate inside of the air channel wall portion 11. The air channel wall portion 11 is a guide arranged to guide an air flow caused by the rotation of the impeller 40 along the central axis C1. An air inlet 16 is defined at an axially upper end of the air channel wall portion 11, while an air outlet 17 is defined at an axially lower end of the air channel wall portion 11. That is, the rotation of the impeller 40 causes air to be sucked through the air inlet 16, and causes the air flow, being accelerated or pressurized by the impeller 40, to be discharged through the air outlet 17.

The flange portions 15 are arranged to extend radially outward from each of both axial end portions of the air channel wall portion 11. Each flange portion 15 includes a fitting hole 151 arranged to pass therethrough in the axial direction. The fitting hole 151 is used when the axial fan A is attached to a device. Specifically, a fitting screw, a boss, or the like provided in the device is inserted into the fitting hole 151 to fix the flange portion 15 to the device, so that the axial fan A is fixed to the device. The flange portions 15 are arranged in the form of a square as illustrated in FIGS. 1, 2, and 4, but may alternatively be arranged in the form of a circle, a rectangle, or another polygon, such as, for example, a hexagon. The form of the flange portions 15 may be determined in accordance with the form of a portion(s) of the device to which the axial fan A is attached.

The base portion 12 is arranged to hold the stator portion 20. The base portion 12 includes, in a center thereof, a base through hole 120 (see FIG. 3) arranged to pass therethrough in the axial direction, and also includes a tubular tube holding portion 121 arranged to project axially upward above a peripheral portion of the base through hole 120.

The base portion 12 is arranged at the axially lower end of the air channel wall portion 11, i.e., at an end of the air channel wall portion 11 on the downstream side with respect to the air flow. The base portion 12 is arranged radially inside of the air channel wall portion 11. The air channel wall portion 11 and the base portion 12 are radially spaced apart from each other. The stationary vanes 13 are arranged in a circumferential direction in a gap between the air channel wall portion 11 and the base portion 12. Each stationary vane 13 is joined to both the air channel wall portion 11 and the base portion 12. In other words, the base portion 12 is held by the air channel wall portion 11 through the stationary vanes 13. The stationary vanes 13 are arranged to control air flows caused by the rotation of the impeller 40 so that the air flows will be axially symmetric with respect to the central axis C1. Accordingly, the stationary vanes are arranged at regular intervals in the circumferential direction. The base portion 12 defines a portion of the housing 10, but the base portion 12 may alternatively be defined by a member separate from the housing 10.

The bearing holding tube portion 14 is cylindrical, and the stator portion 20 is fixed to an outer circumferential surface of the bearing holding tube portion 14. The bearing holding tube portion 14 is fixed to the tube holding portion 121 of the base portion 12 along the central axis C1. The bearing holding tube portion 14 is arranged to hold a first bearing 141 and a second bearing 142 with inner circumferential surfaces of an axially upper end portion and an axially lower end portion, respectively, thereof. As illustrated in FIG. 3, the first bearing 141 is arranged on the axially upper end portion, while the second bearing 142 is arranged on the axially lower end portion. The first and second bearings 141 and 142 are arranged to rotatably support the shaft 31, which will be described below, of the rotor portion 30.

The bearing holding tube portion 14 is fixed to the tube holding portion 121 of the base portion 12 such that the bearing holding tube portion 14 is coaxial with the central axis C1. Accordingly, a center of the stator portion 20, which is fixed to the outer circumferential surface of the bearing holding tube portion 14, coincides with the central axis C1. In addition, a center of the shaft 31, which is rotatably supported by the bearing holding tube portion 14 through the first and second bearings 141 and 142, coincides with the central axis C1. That is, both the center of the stator portion 20 and a center of the rotor portion coincide with the central axis C1. Thus, a radially outer surface of each of tooth portions 212, which will be described below, of the stator portion 20 is arranged radially opposite to an inner circumferential surface of a rotor magnet 34, which will be described below, of the rotor portion 30 with a predetermined distance therebetween.

Each of the first and second bearings 141 and 142 is a ball bearing. The shaft 31 is fixed to an inner race of each of the first and second bearings 141 and 142. The shaft 31 is fixed to the inner race of each of the first and second bearings 141 and 142 through, for example, insertion and adhesion, press fitting, or the like, or by other fixing methods. Note that each of the first and second bearings 141 and 142 is not limited to the ball bearing.

Figure 5:
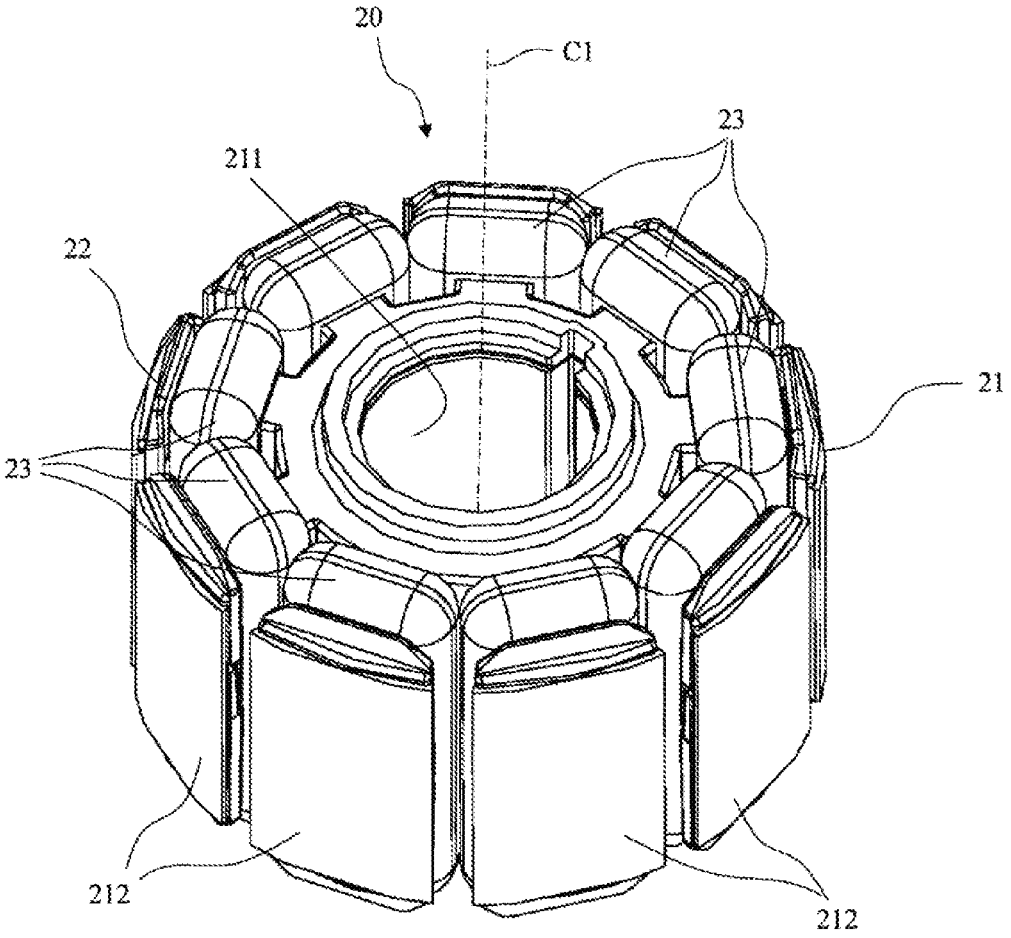
FIG. 5 is a perspective view of a stator portion according to a preferred embodiment of the present disclosure.

The stator portion 20 will now be described in detail below with additional reference to FIG. 5. FIG. 5 is a perspective view of the stator portion 20. Referring to FIGS. 3, 5, and so on, the stator portion 20 includes a stator core 21, an insulator 22, and coils 23. The stator core 21 has electrical conductivity. The stator core 21 includes an annular core back portion 211 and the tooth portions 212. The core back portion 211 is annular, and is arranged to extend in the axial direction. Each tooth portion 212 is arranged to project radially outward from an outer circumferential surface of the core back portion 211. The number of tooth portions 212 included in the stator core 21 is two or more. The tooth portions 212 are arranged at regular intervals in the circumferential direction.

The stator core 21 may be defined by laminated electromagnetic steel sheets, or may alternatively be defined in one piece by sintering of powder, casting, or the like. The stator core 21 may be made up of core segments each of which includes one of the tooth portions 212, or may alternatively be defined by winding a strip-shaped member. The stator core 21 has, in a radial center thereof, a through hole arranged to pass therethrough in the axial direction.

The insulator 22 is a resin casting. The insulator 22 is arranged to cover at least each tooth portion 212 of the stator core 21 in its entirety. A conducting wire is wound around each tooth portion 212 covered with the insulator 22 to define the corresponding coil 23. The insulator 22 provides isolation between the stator core 21 and each coil 23. Although the insulator 22 is a resin casting in the present preferred embodiment, this is not essential to the present invention. Other types of insulator that are able to provide isolation between the stator core 21 and each coil 23 can be widely adopted as the insulator 22.

The coil 23 is arranged around each of the tooth portions 212 of the stator core 21. The coils 23 included in the stator portion 20 can be divided into three groups (hereinafter referred to as three phases) which differ in timing of supply of an electric current. The three phases are defined as a U phase, a V phase, and a W phase, respectively. That is, the stator portion 20 includes U-phase coils, V-phase coils, and W-phase coils, all of which are equal in number. Hereinafter, the coils of the three phases will be simply referred to collectively as the coils 23.

The stator portion 20 is fixed to the bearing holding tube portion 14 with a wall surface of the through hole of the stator core 21 being in contact with the outer circumferential surface of the bearing holding tube portion 14. The stator core 21 and the bearing holding tube portion 14 may be fixed to each other through press fitting, adhesion, or the like, or by other fixing methods. Various methods by which the stator core 21 can be securely fixed to the bearing holding tube portion 14 can be widely adopted.

With the stator core 21 being fixed to the bearing holding tube portion 14, the stator portion 20 is fixed to the base portion 12, i.e., inside of the air channel wall portion 11 of the housing 10. As a result, the tooth portions 212 are arranged at regular intervals around the central axis C1.

Referring to FIG. 3, the rotor portion 30 includes the shaft 31, a rotor yoke 33, and the rotor magnet 34. That is, a motor of the axial fan A includes the shaft 31. The shaft 31 is columnar. The shaft 31 is arranged to extend in the axial direction along the central axis C1. The rotor yoke 33 is made of a metal.

Figure 6:
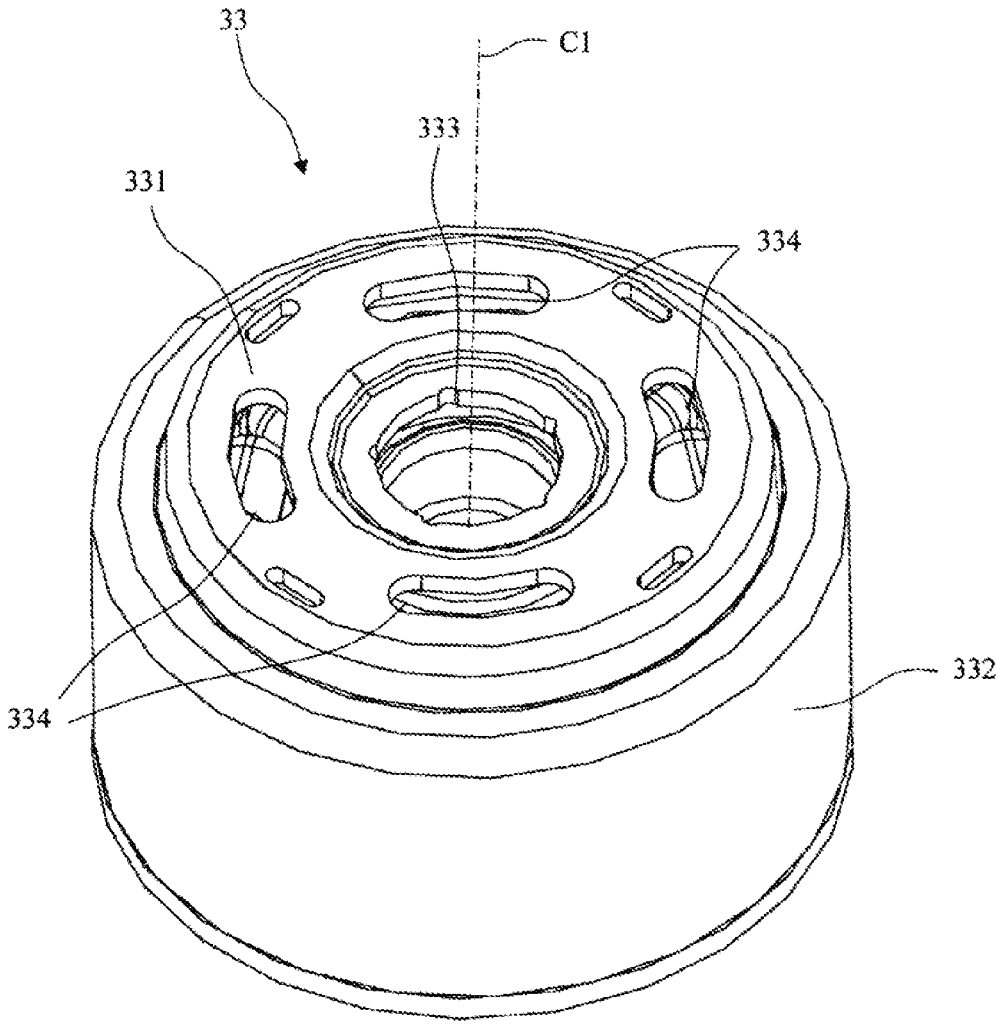
FIG. 6 is a perspective view of a rotor yoke according to a preferred embodiment of the present disclosure.

The rotor yoke 33 will now be described in detail below with additional reference to FIG. 6. FIG. 6 is a perspective view of the rotor yoke 33. Referring to FIG. 6, the rotor yoke 33 includes a rotor top plate portion 331 and a rotor tubular portion 332. The rotor top plate portion 331 is arranged to extend radially, and is in the shape of a disk when viewed in the axial direction. The rotor top plate portion 331 includes, in a center thereof, a central through hole 333 arranged to pass therethrough in the axial direction. The rotor top plate portion 331 includes a plurality (four in the present preferred embodiment) of positioning holes 334 each of which is arranged to pass therethrough in the axial direction. First bosses 413, which will be described below, of the impeller 40 are inserted into the positioning holes 334.

The rotor tubular portion 332 is tubular, and is arranged to extend axially downward from a radially outer edge of the rotor top plate portion 331. The rotor tubular portion 332 is fixed to an inner fixing portion 43, which will be described below, of the impeller 40 through press fitting. A coupling portion 32 is inserted into the central through hole 333.

The coupling portion 32 is arranged to couple and fix the rotor top plate portion 331 and the shaft 31 to each other. The coupling portion 32 includes a coupling hole 321, a yoke fixing portion 322, and a coupling tube portion 323. The coupling tube portion 323 is tubular, extending in the axial direction. The yoke fixing portion 322 is arranged at an axially lower end of the coupling tube portion 323. The coupling hole 321 is arranged to pass through the coupling tube portion 323 in the axial direction.

An axially upper end portion of the shaft 31 is inserted into the coupling hole 321. The axially upper end portion of the shaft 31 is press fitted into the coupling hole 321 to be fixed to the coupling portion 32. The yoke fixing portion 322 is inserted into the central through hole 333 of the rotor yoke 33. The yoke fixing portion 322 includes a cylindrical outer surface arranged to be in contact with and fixed to a wall surface of the central through hole 333. The coupling tube portion 323 is inserted into an axial through hole 414, which will be described below, of the impeller 40, and is fixed in the axial through hole 414. The coupling tube portion 323 may be fixed in the axial through hole 414 through, for example, adhesion, welding, or the like, or by other fixing methods.

The coupling portion 32 is arranged to fix the shaft 31 and the impeller 40 to each other, and fix the shaft 31 and the rotor yoke 33 to each other. In other words, each of the impeller 40 and the rotor yoke 33 is fixed to the shaft 31 through the coupling portion 32. That is, the impeller 40 is fixed to the shaft 31, and is arranged to be capable of rotating about the central axis C1.

The rotor magnet 34 is tubular, and includes north and south poles arranged to alternate with each other in the circumferential direction. The rotor magnet 34 is fixed with an outer circumferential surface thereof being in contact with an inner circumferential surface of the rotor yoke 33. The rotor magnet 34 may be molded in one piece of a resin containing magnetic powder, or may alternatively be defined by a plurality of magnets arranged in the circumferential direction and fixed to one another through a resin or the like. The rotor magnet 34 may be fixed to the rotor yoke 33 through press fitting, adhesion, or the like, or by other fixing methods. Various methods by which the rotor magnet 34 can be securely fixed to the rotor yoke 33 can be widely adopted.

The shaft 31 is rotatably attached to the bearing holding tube portion 14 through the first and second bearings 141 and 142 held by the bearing holding tube portion 14. Then, the rotor yoke 33 with the rotor magnet 34 fixed thereto is fixed to the shaft 31 through the coupling portion 32. At this time, the radially inner circumferential surface of the rotor magnet 34 is arranged radially opposite to the radially outer surface of each of the tooth portions 212 of the stator portion 20, which is fixed to the bearing holding tube portion 14, with a gap therebetween. The base portion 12, the bearing holding tube portion 14, the stator portion 20, and the rotor portion 30 together define a brushless DC motor of a so-called outer-rotor type, in which the rotor magnet 34 of the rotor portion 30 is arranged radially outside of the stator portion 20. Although the base portion 12 defines a portion of the housing 10 in the present preferred embodiment, the base portion 12 may alternatively be defined by a member separate from the housing 10. In this alternative case, the motor may be assembled separately, and be attached to the housing 10.

Magnetic flux generated as a result of electric currents being passed through the coils 23 of the stator portion 20 causes an attractive force or a repulsive force to be applied to the rotor magnet 34. The attractive force or the repulsive force applied to the rotor magnet 34 causes the rotor portion 30 to rotate about the central axis C1 with respect to the stator portion 20. Rotation of the rotor portion 30 causes the impeller 40 fixed to the rotor portion 30 to rotate about the central axis C1.

Figure 7:
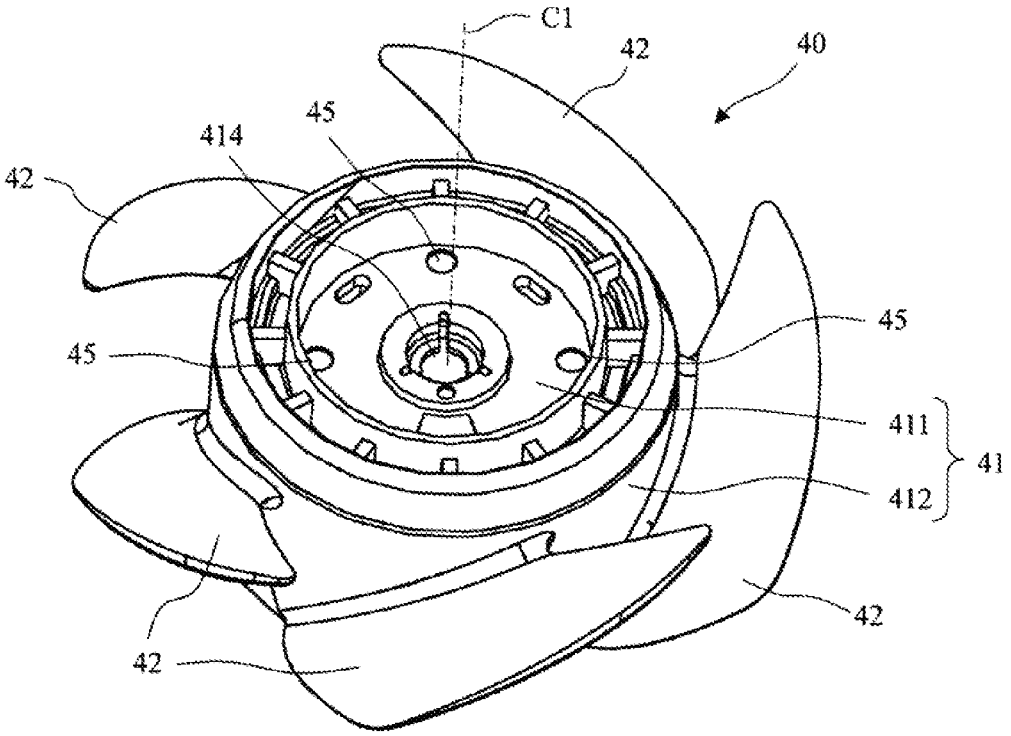
FIG. 7 is a perspective view of an impeller according to a preferred embodiment of the present disclosure.
Figure 8:
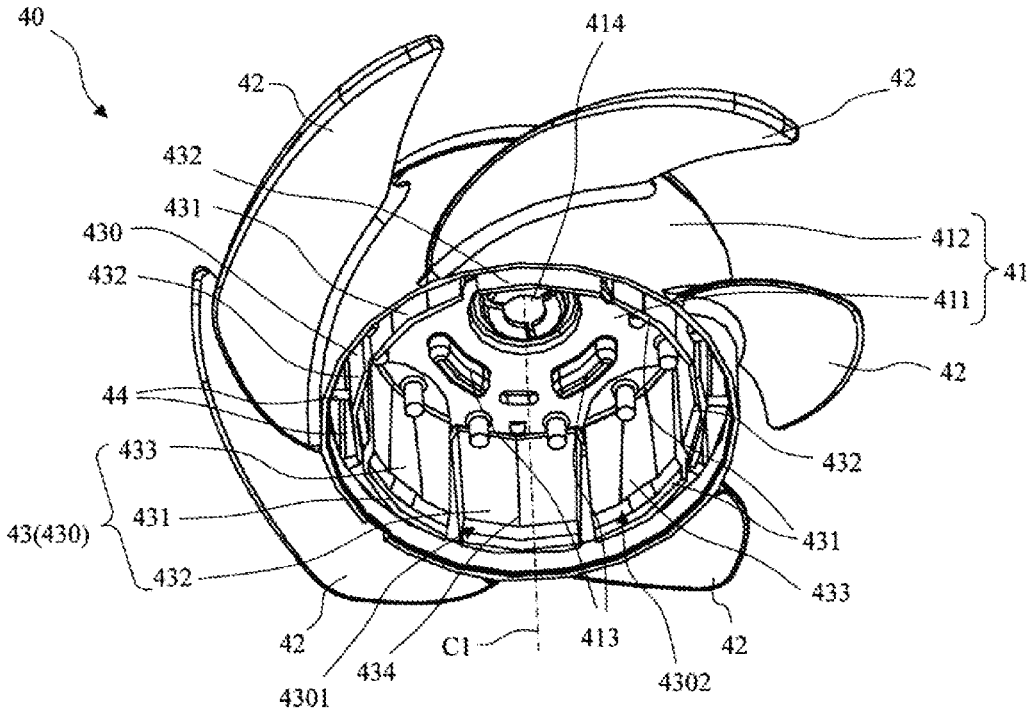
FIG. 8 is a perspective view of the impeller illustrated in FIG. 7 as viewed from below.
Figure 9:
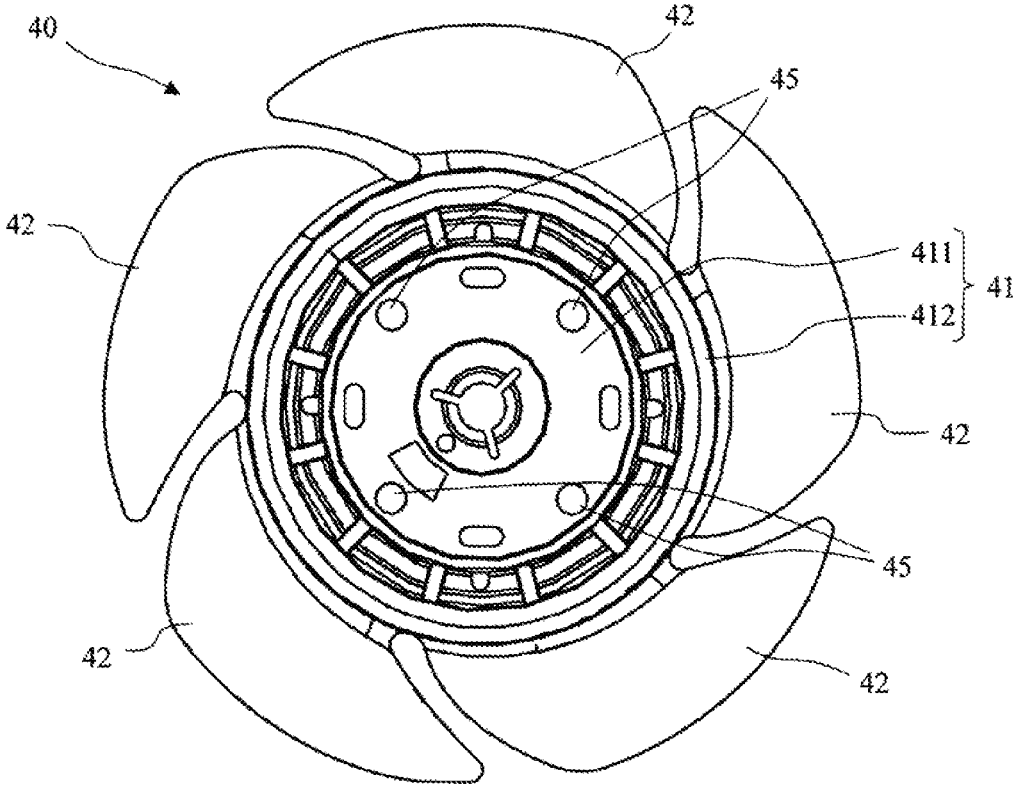
FIG. 9 is a plan view of the impeller illustrated in FIG. 7.
Figure 10:
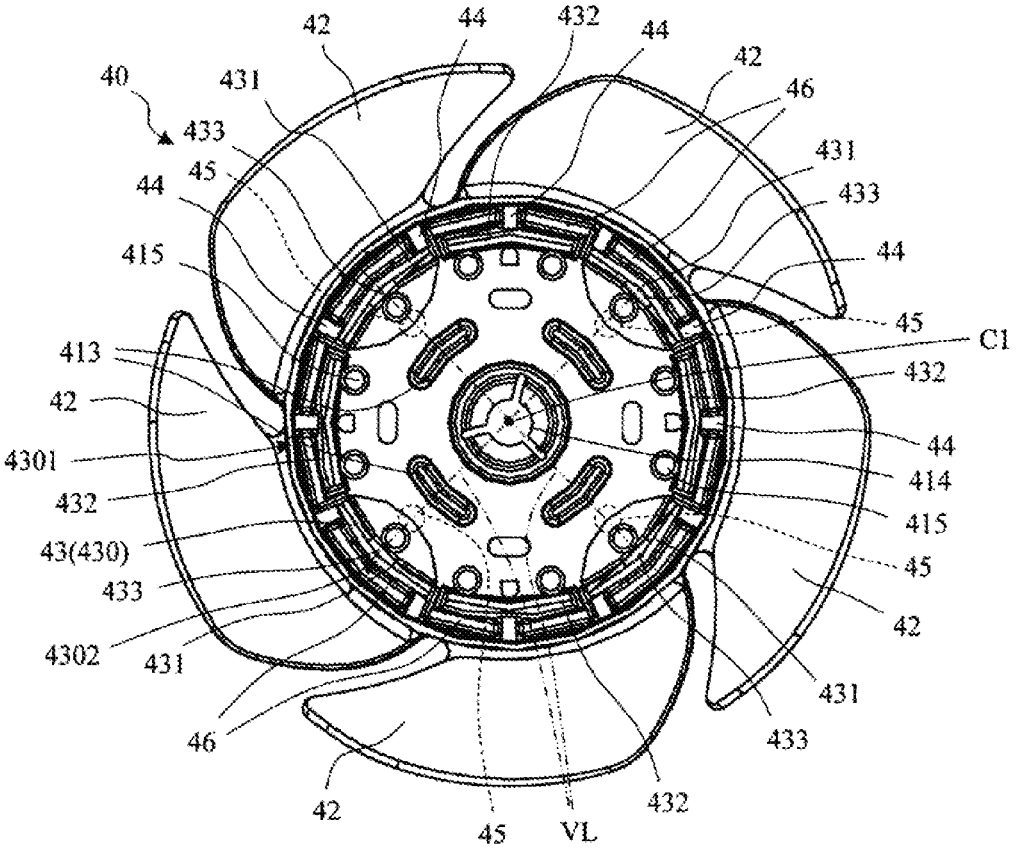
FIG. 10 is a bottom view of the impeller illustrated in FIG. 7.

The impeller 40 will now be described in detail below with additional reference to FIGS. 7, 8, 9, and 10. FIG. 7 is a perspective view of the impeller 40. FIG. 8 is a perspective view of the impeller 40 illustrated in FIG. 7 as viewed from below. FIG. 9 is a plan view of the impeller 40 illustrated in FIG. 7. FIG. 10 is a bottom view of the impeller 40 illustrated in FIG. 7.

Referring to FIGS. 7 to 10, the impeller 40 includes an impeller hub 41, a plurality of blades 42, and the inner fixing portion 43. The impeller 40 is defined by a resin injection molding process.

Referring to FIGS. 3, 7, 8, and so on, the impeller hub 41 includes a hub top plate portion 411 and a hub tubular portion 412. The hub top plate portion 411 is in the shape of a disk, extending radially. The hub tubular portion 412 is tubular, and is arranged to extend axially downward from a radially outer edge of the hub top plate portion 411. The hub top plate portion 411 is provided with the first bosses 413, the axial through hole 414, and second bosses 415. The axial through hole 414 is a through hole arranged to pass through the hub top plate portion 411 in the axial direction, and arranged in a radial center of the hub top plate portion 411. The coupling tube portion 323 of the coupling portion 32 is inserted into and fixed in the axial through hole 414. In other words, the shaft 31 is fixed in the axial through hole 414 through the coupling tube portion 323. That is, the impeller hub 41 is tubular, and is directly or indirectly fixed to the shaft 31.

Each of the first and second bosses 413 and 415 is arranged to project axially downward from an axially lower surface of the hub top plate portion 411. Each of the first and second bosses 413 and 415 is made of the same material as that of the hub top plate portion 411, and is defined integrally with the hub top plate portion 411. Here, the number of first bosses 413 is four. The first bosses 413 are inserted into the positioning holes 334 of the rotor yoke 33. The rotor yoke 33 is thus circumferentially positioned with respect to the impeller hub 41.

Each second boss 415 is arranged to have an axial dimension smaller than that of each first boss 413. An upper surface of the rotor top plate portion 331 of the rotor yoke 33 is arranged to be in contact with an axially lower surface of each second boss 415. That is, the rotor yoke 33 is axially positioned with respect to the impeller hub 41 with the upper surface of the rotor top plate portion 331 being in contact with the axially lower surface of each second boss 415.

Referring to FIGS. 7 and 9, a plurality of gate marks 45 are defined in an upper surface of the hub top plate portion 411 of the impeller hub 41. Each gate mark 45 is a mark defined at an inlet (i.e., a gate) defined in a mold (not shown) and through which a resin is injected into the mold when a resin injection molding process is performed for the impeller hub 41. The number of gate marks 45 is four, and the four gate marks 45 are arranged at regular intervals in the circumferential direction around the central axis C1.

When the resin is injected into the mold through a plurality of gates, a weld, where different flows of the resin meet, is defined at a middle position circumferentially between circumferentially adjacent ones of the gates. That is, the weld is defined at a middle position circumferentially between circumferentially adjacent ones of the gate marks 45. The weld will be described in detail below.

The blades 42 are arranged side by side in the circumferential direction on an outer surface of the impeller hub 41. In the present preferred embodiment, on the outer surface of the impeller hub 41, the blades 42 are arranged side by side at predetermined intervals in the circumferential direction, and are integrally molded with the impeller hub 41. An upper portion of each blade 42 is arranged forward of a lower portion of the blade 42 with respect to a rotation direction Rd of the impeller 40 (see FIG. 2). The upper portion of each blade 42 is arranged forward of the lower portion of the blade 42 with respect to the rotation direction Rd.

Figure 11:
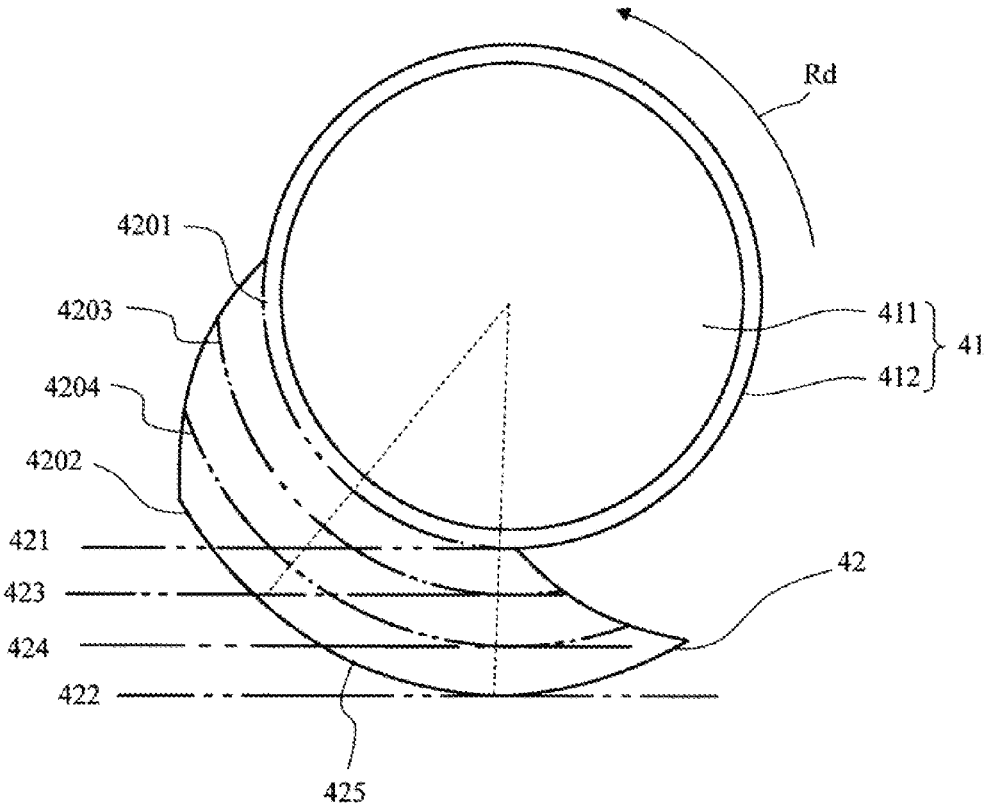
FIG. 11 is a plan view illustrating a circumferential development of a blade attached to an impeller hub according to a preferred embodiment of the present disclosure.

The blades 42 will now be described in more detail below with additional reference to FIG. 11. FIG. 11 is a plan view illustrating a circumferential development of one of the blades 42 attached to the impeller hub 41.

Referring to FIG. 11, a radially innermost portion and a radially outermost portion of the blade 42 will be referred to as an innermost portion 4201 and an outermost portion 4202, respectively. As illustrated in FIG. 11, the innermost portion 4201 is distant from a center of the outer surface of the impeller hub 41 by a distance equal to a radius of the outer surface of the impeller hub 41. A first intermediate portion 4203 and a second intermediate portion 4204 are defined radially between the innermost portion 4201 and the outermost portion 4202 of the blade 42. The innermost portion 4201, the first intermediate portion 4203, the second intermediate portion 4204, and the outermost portion 4202 are equally spaced from one another. In other words, the first intermediate portion 4203 corresponds to a radially inner one of two lines that divide the blade 42 into three parts having the same radial width. In addition, the second intermediate portion 4204 corresponds to a radially outer one of the two lines that divide the blade 42 into three parts having the same radial width.

Referring to FIG. 11, the blade 42 is joined to the impeller hub 41 at the innermost portion 4201. In other words, the innermost portion 4201 corresponds to a junction of the blade 42 with the outer surface of the impeller hub 41. Meanwhile, radially outside of the innermost portion 4201 of the blade 42, a forward portion of the blade 42 with respect to the rotation direction Rd includes a portion lying forward of a foremost portion of the innermost portion 4201 with respect to the rotation direction Rd. This portion is not joined to the impeller hub 41 in a radial direction, and is therefore low in strength. Accordingly, the forward portion of the blade 42 with respect to the rotation direction Rd is prone to being deformed radially outward during the rotation of the impeller 40. In addition, a rearward portion of the blade 42 with respect to the rotation direction Rd has a reduced radial dimension in a section taken along a plane including the central axis C1, resulting in a reduced section modulus. Accordingly, the rearward portion of the blade 42 with respect to the rotation direction Rd is also prone to being deformed radially outward during the rotation of the impeller 40. Moreover, the rearward portion of the blade 42 with respect to the rotation direction Rd is a portion where an air flow caused by the rotation of the impeller 40 separates from the blade 42, and therefore receives an increased stress. This makes the rearward portion of the blade 42 with respect to the rotation direction Rd more prone to being deformed radially outward.

While the blade 42 is rotating, a section of the blade 42 taken along a plane including the central axis C1 has a greater section modulus as the radial dimension of the section increases. Thus, a portion of the blade 42 which is fixed to the impeller hub 41 in a radial direction is not easily deformed radially. This characteristic is taken into account to determine the shape of the blade 42.

Figure 12:
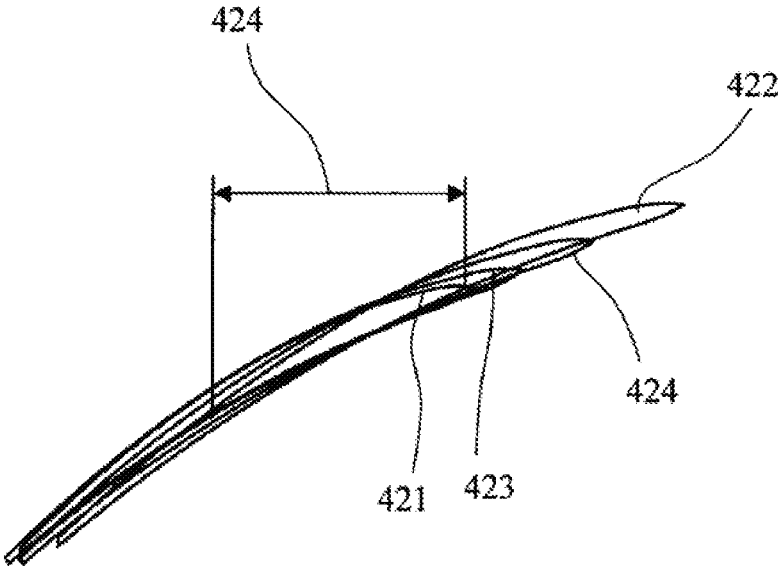
FIG. 12 is a diagram depicting circumferential developed blades according to a preferred embodiment of the present disclosure superimposed on each other, the circumferential developed blades being circumferential developments of circumferential sections of the blade taken at different radial positions.

A method for determining a portion of the blade 42 which has a large radial dimension will now be described below with reference to the accompanying drawings. FIG. 12 is a diagram depicting circumferential developed blades superimposed on each other. The circumferential developed blades are circumferential developments of circumferential sections of the blade 42 taken at different radial positions.

FIG. 12 is a diagram depicting circumferential developments of the innermost portion 4201, the outermost portion 4202, the first intermediate portion 4203, and the second intermediate portion 4204 of the blade 42. In each of the developments of FIGS. 11 and 12, an upstream end portion of the innermost portion 4201 with respect to the rotation direction Rd of the impeller 40 is used as a reference. Referring to FIG. 12, an inner circumferential developed blade 421 is a circumferential development of the innermost portion 4201 of the blade 42. Similarly, an outer circumferential developed blade 422 is a circumferential development of the outermost portion 4202 of the blade 42, and a first intermediate circumferential developed blade 423 and a second intermediate circumferential developed blade 424 are circumferential developments of the first intermediate portion 4203 and the second intermediate portion 4204, respectively, of the blade 42.

The blade 42 is joined to the impeller hub 41 on a rearward side, with respect to the rotation direction Rd, of a foremost portion of the inner circumferential developed blade 421 with respect to the rotation direction Rd. A portion of the blade 42 where all of the inner circumferential developed blade 421, the outer circumferential developed blade 422, the first intermediate circumferential developed blade 423, and the second intermediate circumferential developed blade 424 overlap when viewed in the radial direction has a large radial dimension, and is therefore not easily deformed. It is assumed here that the portion of the blade 42 where all of the inner circumferential developed blade 421, the outer circumferential developed blade 422, the first intermediate circumferential developed blade 423, and the second intermediate circumferential developed blade 424 overlap when viewed in the radial direction is referred to as a first portion 425. After being determined with the circumferential developments superimposed on each other, the first portion 425 is transformed from the development back into a three-dimensional space to determine the first portion 425 of the blade 42 (see FIGS. 2, 11, and so on). In each of FIGS. 2 and 11, both ends of the first portion 425 with respect to the rotation direction are indicated by broken lines.

In the blade 42, the first portion 425 is not easily deformed radially outward during the rotation of the blade 42. Referring to FIG. 2, when the impeller 40 has been housed in the air channel wall portion 11 of the housing 10, a gap Gp1 between the inner surface of the air channel wall portion 11 and a portion (hereinafter referred to as a "radially outermost portion") of the first portion 425 of the blade 42 which lies most radially outward is smaller than a gap Gp2 between the inner surface of the air channel wall portion 11 and a radially outermost portion of a portion of the blade 42 on a forward side of the first portion 425 with respect to the rotation direction. In addition, the gap Gp1 is smaller than a gap Gp3 between the inner surface of the air channel wall portion 11 and a radially outermost portion of a portion of the blade 42 on the rearward side of the first portion 425 with respect to the rotation direction. That is, the radially outermost portion of the blade 42 is at the shortest distance from the inner surface of the air channel wall portion 11 in at least a portion of the first portion 425.

The distance between the radially outermost portion of the blade 42 and the inner surface of the air channel wall portion 11 is arranged to gradually increase in a forward direction with respect to the rotation direction from the first portion 425. Similarly, the distance between the radially outermost portion of the blade 42 and the inner surface of the air channel wall portion 11 is arranged to gradually increase in a rearward direction with respect to the rotation direction from the first portion 425.

The above arrangement contributes to optimizing a gap between the inner surface of the air channel wall portion 11 and a radially outer edge of each blade 42 of the impeller 40 for the rotation of the impeller 40, and increasing efficiency in air blowing by the rotation of the impeller 40. The rearward portion of the blade 42 with respect to the rotation direction is a portion where an air flow separates from the blade 42, and therefore receives greater stress than other portions of the blade 42. Accordingly, it is preferable that the radial distance between the radially outermost portion of the blade 42 and the inner surface of the air channel wall portion 11 is greatest at a rearward end portion of the radially outermost portion of the blade 42 with respect to the rotation direction.

Referring to FIG. 2, when the blade 42 is viewed in the axial direction, the area (i.e., the axially projected area) of the first portion 425 is smaller than a sum of the area of a portion 426 of the blade 42 on the forward side of the first portion 425 with respect to the rotation direction and the area of a portion 427 of the blade 42 on the rearward side of the first portion 425 with respect to the rotation direction. The above arrangement allows the gap between the radially outermost portion of the blade 42 and the inner surface of the air channel wall portion 11 to be adjusted to achieve further optimization of the gap.

Although, in the present preferred embodiment, two portions (i.e., the first intermediate portion 4203 and the second intermediate portion 4204) of the blade 42 are adopted as radially intermediate portions of the blade 42, this is not essential to the present invention. Only one portion or more than two portions of the blade 42 may alternatively be adopted as the radially intermediate portion(s) of the blade 42. In addition, it is preferable that the portion of the first portion 425 where the radially outermost portion of the blade 42 is at the shortest radial distance from the inner surface of the air channel wall portion 11 is arranged to have a circumferential dimension greater than a half of the circumferential dimension of the outer circumferential developed blade 422.

Figure 13:
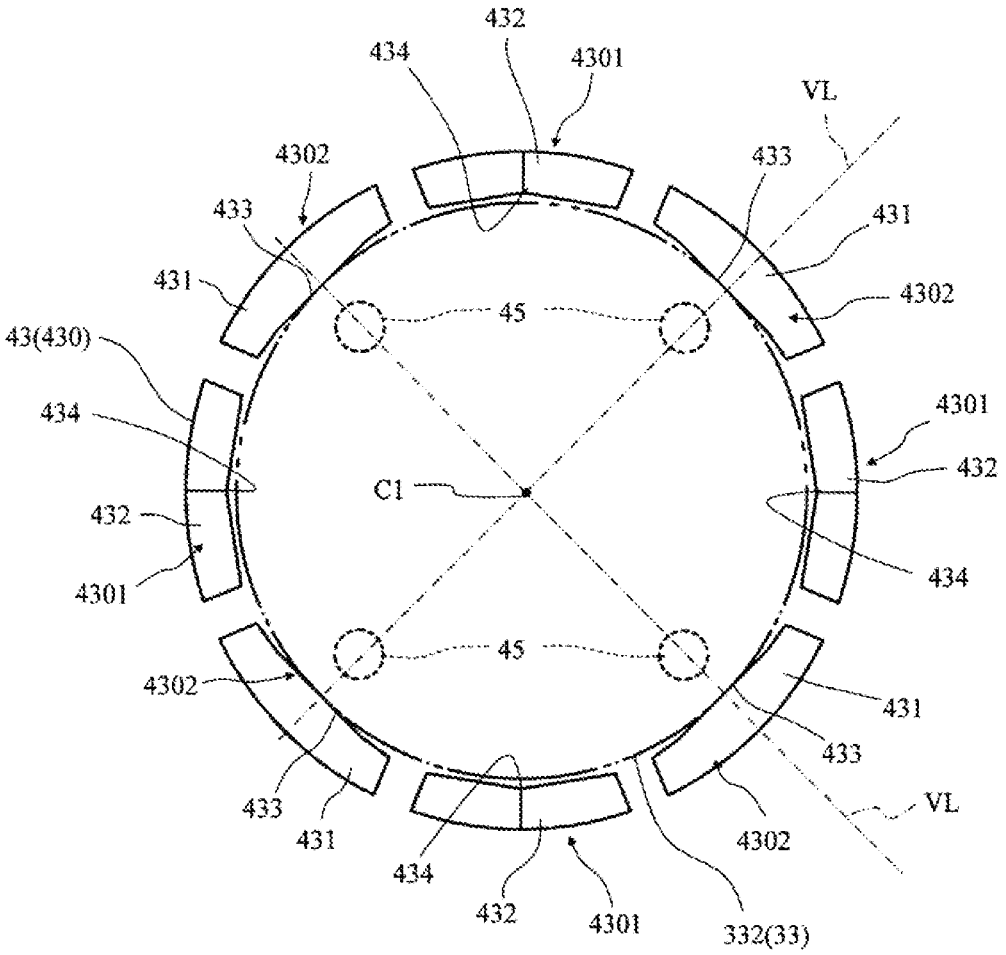
FIG. 13 is a schematic bottom view illustrating an arrangement of an inner fixing portion according to a preferred embodiment of the present disclosure.

The inner fixing portion 43 will now be described in detail below with additional reference to FIG. 13. FIG. 13 is a schematic bottom view illustrating an arrangement of the inner fixing portion 43. Referring to FIGS. 8, 10, and 13, the inner fixing portion 43 is arranged radially inside of the hub tubular portion 412. The inner fixing portion 43 includes wall portions 430 arranged in the circumferential direction. Each wall portion 430 is arranged to extend axially downward from the lower surface of the hub top plate portion 411. Each wall portion 430 is molded integrally with the hub top plate portion 411. The inner fixing portion 43 may be tubular, extending in the axial direction.

The wall portions 430 include four first wall portions 431 and four second wall portions 432. Each first wall portion 431 includes an increased thickness portion 433 having a radially inner surface arranged at a shorter distance from the central axis C1 than any other portion of a radially inner surface of the first wall portion 431. The four first wall portions 431 are arranged at regular intervals in the circumferential direction. The rotor tubular portion 332 is press fitted to the inner fixing portion 43 while being in contact with the inner fixing portion 43, more specifically, with some of the wall portions 430. Referring to FIG. 13, the radially inner surface of the increased thickness portion 433 is arranged to be in contact with an outer surface of the rotor tubular portion 332. The rotor tubular portion 332 is press fitted to the inner fixing portion 43 while being in contact with the increased thickness portion 433. The distance of the increased thickness portion 433 from the central axis C1 is arranged to continuously increase from a circumferential middle of the increased thickness portion 433 in circumferentially outward directions.

Each second wall portion 432 is arranged circumferentially between adjacent ones of the first wall portions 431. The four second wall portions 432 are arranged at regular intervals in the circumferential direction. That is, the first wall portions 431 and the second wall portions 432 are arranged alternately and at regular intervals in the circumferential direction.

A weld 434 is defined in a circumferential middle of a radially inner surface of each second wall portion 432. The weld 434 is a portion of the second wall portion 432 where flows of the resin coming from different directions have met, and is therefore lower in strength than other portions of the second wall portion 432. Accordingly, when the rotor tubular portion 332 is press fitted to the inner fixing portion 43, more specifically, to some of the wall portions 430, the radially inner surface of the second wall portion 432 is arranged opposite to the outer surface of the rotor tubular portion 332 with a gap therebetween to prevent a concentration of stress on the weld 434 at the time of the press fitting or during the rotation of the impeller 40.

The inner fixing portion 43 includes first regions 4301 each of which is arranged radially opposite to the outer surface of the rotor tubular portion 332 with a gap therebetween, and each of which has the weld 434 defined in a radially inner surface thereof. The inner fixing portion 43 also includes second regions 4302 each of which is arranged to be in contact with the outer surface of the rotor tubular portion 332.

Each weld 434 is defined at a middle position between adjacent ones of the gate marks 45. Each second region 4302 is arranged circumferentially between adjacent ones of the first regions 4301. Accordingly, each second region 4302 is arranged in a region between circumferentially adjacent ones of the welds 434. That is, at least a portion of the outer surface of the rotor tubular portion 332 is arranged to be in contact with an inner surface of a portion of the inner fixing portion 43 (i.e., the second region 4302) which lies in a region between a middle position between each gate mark 45 and a circumferentially adjacent one of the gate marks 45 and a middle position between the gate mark 45 and another circumferentially adjacent one of the gate marks 45. Each first wall portion 431 is arranged on an imaginary line VL that joins a corresponding one of the gate marks 45 and the central axis C1 (see FIGS. 3, 13, and so on).

Referring to FIGS. 3, 8, and 10, the impeller hub 41 includes a recessed portion 46 being recessed axially upward from an axially lower end portion thereof radially between the hub tubular portion 412 and the wall portions 430. Each wall portion 430 is joined to a radially inner surface of the hub tubular portion 412 through a joining portion(s) 44 arranged in the recessed portion 46. Each joining portion 44 is arranged to extend in the axial direction. The recessed portion 46 is arranged to have an axial dimension smaller than that of the impeller hub 41.

Referring to FIG. 10, both circumferential ends of each first wall portion 431 are joined to the hub tubular portion 412 through the corresponding joining portions 44. A circumferential middle portion of the first wall portion 431 defines the increased thickness portion 433. The circumferential middle portion of the first wall portion 431 and the hub tubular portion 412 are arranged radially opposite to each other with the recessed portion 46 therebetween. The above arrangement allows the first wall portion 431 to bend. This allows stress to be distributed when the rotor tubular portion 332 is press fitted to the inner fixing portion 43. The first wall portion 431 is made of the resin, while the rotor tubular portion 332 is made of the metal. Accordingly, an increase in temperature of the first wall portion 431 and the rotor tubular portion 332 will cause the first wall portion 431 to experience a greater thermal expansion than the rotor tubular portion 332. Provision of the recessed portion 46 between the hub tubular portion 412 and a radially outer side of the circumferential middle portion of the first wall portion 431 allows the first wall portion 431 to be deformed radially outward. This contributes to limiting an increase in stress caused by a difference in thermal expansion at an area of contact between the first wall portion 431 and the rotor tubular portion 332.

A radially outer side of a circumferential middle portion of each second wall portion 432 is joined to the radially inner surface of the hub tubular portion 412 through the corresponding joining portion 44. Each second wall portion 432 is joined to the radially inner surface of the hub tubular portion 412 through a single one of the joining portions 44. As mentioned above, the circumferential middle portion of the second wall portion 432 includes the weld 434. A portion of the second wall portion 432 in which the weld 434 is defined is joined to the radially inner surface of the hub tubular portion 412 through the corresponding joining portion 44, so that an increase in strength of the portion of the second wall portion 432 in which the weld 434 is defined can be achieved. In addition, a difference in thermal expansion between the second wall portion 432 and the rotor tubular portion 332 would not lead to a significant increase in stress, since the second wall portion 432 and the rotor tubular portion 332 are radially spaced apart from each other with the gap therebetween.

The above arrangement contributes to preventing an increase in stress on the inner fixing portion 43 (i.e., the wall portions 430) even if the temperatures of the inner fixing portion 43 (i.e., the wall portions 430) and the rotor tubular portion 332 become higher when the axial fan A is running than when the rotor yoke 33 was press fitted to the impeller hub 41. This in turn contributes to reducing a change in internal stress caused by a temperature change between the time of manufacture (i.e., the time of the press fitting) and the time when the axial fan A is running, and thus allows the impeller 40 to rotate with stability.

Figure 14:
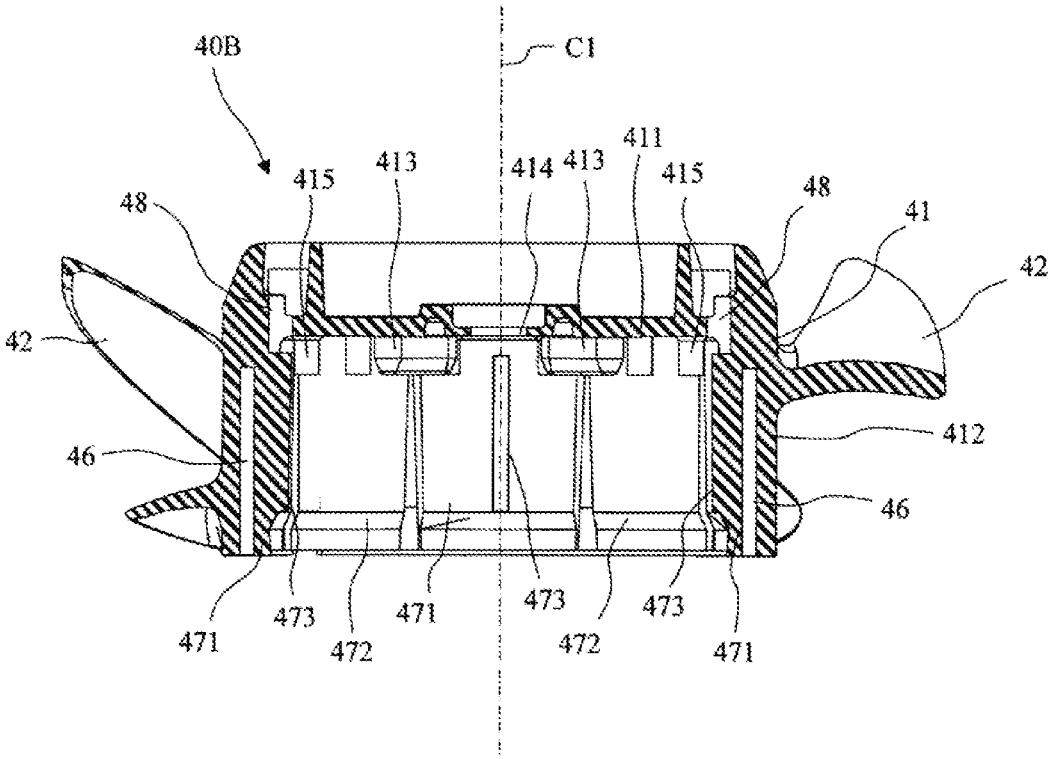
FIG. 14 is a vertical sectional view of an impeller used in an axial fan according to another preferred embodiment of the present disclosure.
Figure 15:
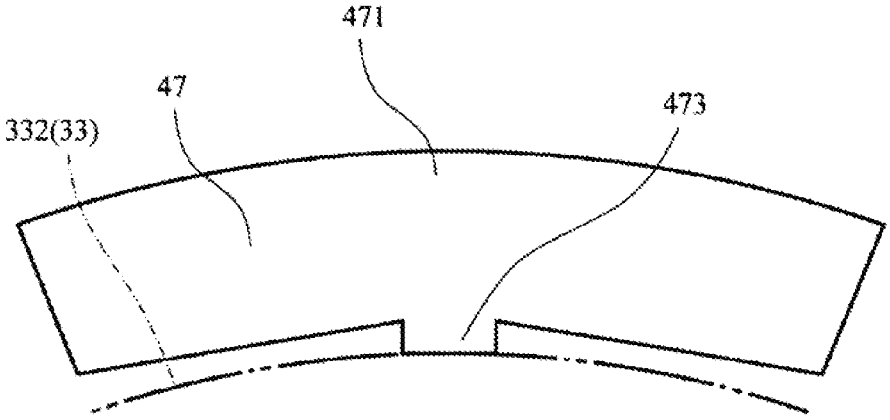
FIG. 15 is a schematic bottom view of one of first wall portions included in the impeller illustrated in FIG. 14.

An axial fan according to a second preferred embodiment of the present disclosure will now be described below with reference to the accompanying drawings. FIG. 14 is a vertical sectional view of an impeller 40B used in the axial fan according to the second preferred embodiment of the present disclosure. FIG. 15 is a schematic bottom view of one of first wall portions 471 included in the impeller 40B illustrated in FIG. 14. The axial fan according to the second preferred embodiment is similar in structure to the axial fan A according to the first preferred embodiment except in the structure of the impeller 40B. Accordingly, detailed descriptions of members of the axial fan according to the second preferred embodiment other than the impeller 40B are omitted.

Referring to FIG. 14, the impeller 40B is different in structure from the impeller 40 according to the first preferred embodiment in that wall portions 47 are provided in place of the wall portions 430 of the impeller 40. The wall portions 47 include the first wall portions 471 and second wall portions 472. Each second wall portion 472 is substantially identical in structure to each second wall portion 432 of the impeller 40. That is, each second wall portion 472 is arranged radially opposite to a rotor tubular portion 332 with a gap therebetween.

Referring to FIGS. 14 and 15, each first wall portion 471 includes a rib 473 arranged to project radially inward in a circumferential middle of a radially inner surface thereof. In the first wall portion 471, the rib 473 defines an increased thickness portion. Accordingly, when a rotor yoke 33 has been press fitted to an impeller hub 41 of the impeller 40B, a radially outer surface of the rotor tubular portion 332 is in contact with a radially inner surface of the rib 473.

Referring to FIG. 14, a gap is defined between the rib 473 and an axially lower surface of a hub top plate portion 411. The hub top plate portion 411 includes, in a region axially opposed to the rib 473, a through hole 48 arranged to pass therethrough in the axial direction.

The gap defined between an upper end of the rib 473 and the hub top plate portion 411 reduces the likelihood that a press-fitting stress will be transferred to a hub tubular portion 412 of the impeller hub 41 when the rotor yoke 33 is press fitted to the impeller hub 41. This contributes to preventing a deformation of the impeller hub 41.

Provision of the through hole 48 allows the gap between the rib 473 and the hub top plate portion 411 to be defined using an insert (i.e., a mold) which is to be drawn in the axial direction in a resin injection molding process. This allows use of a mold having a simplified structure.

The second preferred embodiment is otherwise similar to the first preferred embodiment.

Figure 16:
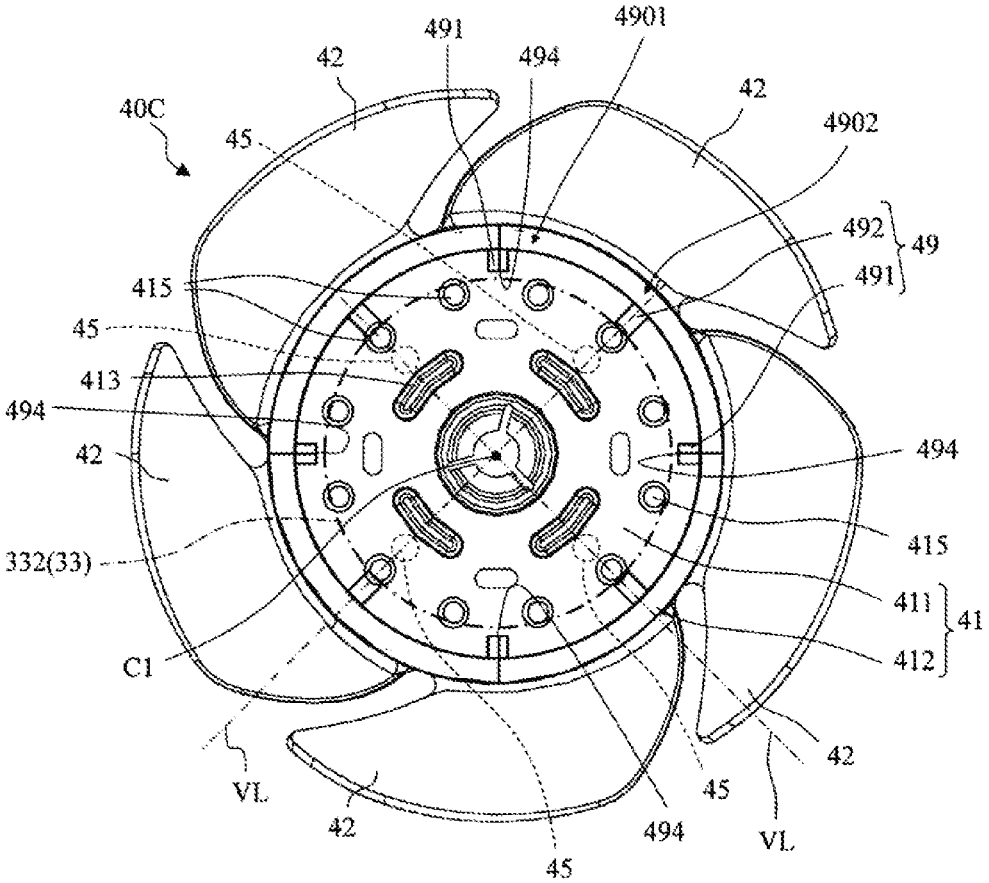
FIG. 16 is a bottom view of an impeller used in an axial fan according to yet another preferred embodiment of the present disclosure.

An axial fan according to a third preferred embodiment of the present disclosure will now be described below with reference to the accompanying drawings. FIG. 16 is a bottom view of an impeller 40C used in the axial fan according to the third preferred embodiment of the present disclosure. The axial fan according to the third preferred embodiment is similar in structure to the axial fan A according to the first preferred embodiment except in the structure of the impeller 40C. Accordingly, detailed descriptions of members of the axial fan according to the third preferred embodiment other than the impeller 40C are omitted.

Referring to FIG. 16, the impeller 40C is different in structure from the impeller 40 in that an inner fixing portion 49 is provided in place of the inner fixing portion 43 of the impeller 40. The inner fixing portion 49 includes first projecting portions 491 and second projecting portions 492. Each of the first and second projecting portions 491 and 492 is arranged to project radially inward from a radially inner surface of a hub tubular portion 412. Each second projecting portion 492 is arranged to project radially inward to a greater extent than each first projecting portion 491. Accordingly, when a rotor yoke 33 has been press fitted to an impeller hub 41, a radially outer surface of a rotor tubular portion 332 is in contact with a radially inner surface of each second projecting portion 492.

Referring to FIG. 16, a weld 494 is defined in a radially inner surface of each first projecting portion 491. Each second projecting portion 492 is arranged radially outside of a corresponding one of gate marks 45. In more detail, each second projecting portion 492 is arranged on an imaginary line VL that joins the corresponding gate mark 45 and a central axis C1.

With the above arrangement, the weld 494 is defined in each first projecting portion 491, on which a stress at the time of the press fitting will not act. In addition, each second projecting portion 492, which is arranged to be in contact with the rotor tubular portion 332, is arranged in the vicinity of the corresponding gate mark 45, where a high strength is provided. This contributes to preventing a deformation when the rotor yoke 33 is press fitted to the impeller hub 41. Each first projecting portion 491 includes a first region 4901 arranged opposite to the radially outer surface of the rotor tubular portion 332 with a gap therebetween. Each second projecting portion 492 includes a second region 4902 arranged to be in radial contact with the radially outer surface of the rotor tubular portion 332.

The third preferred embodiment is otherwise similar to the first preferred embodiment.

While preferred embodiments of the present disclosure have been described above, various modifications and combinations of features of the preferred embodiments are possible without departing from the scope and spirit of the present disclosure.

An axial fan A according to a preferred embodiment of the present disclosure includes a motor including a shaft 31 arranged to extend along a central axis C1 extending in a vertical direction; an impeller 40 fixed to the shaft 31, and arranged to be capable of rotating about the central axis C1; and a housing 10 including an air channel wall portion 11 being tubular, extending in an axial direction, and arranged radially outside of the impeller 40. The impeller 40 includes a tubular impeller hub 41 directly or indirectly fixed to the shaft 31, and a plurality of blades 42 arranged in a circumferential direction on an outer surface of the impeller hub 41. Each blade 42 includes a first portion 425 where all of an inner circumferential developed blade 421, an outer circumferential developed blade 422, and an intermediate circumferential developed blade 423, 424 superimposed on each other overlap when viewed in a radial direction. The inner circumferential developed blade 421 is a circumferential development of a junction of the blade 42 with the outer surface of the impeller hub 41. The outer circumferential developed blade 422 is a circumferential development of a radially outermost portion of the blade 42. The intermediate circumferential developed blade 423, 424 is a circumferential development of a radially intermediate portion of the blade 42 between the junction and the radially outermost portion of the blade 42. The radially outermost portion of the blade 42 is at the shortest radial distance from an inner surface of the air channel wall portion 11 in at least a portion of the first portion 425.

The above structure enables the width of a gap between the blade 42 and the air channel wall portion 11 to be restricted to an appropriate range even when the blade 42 is deformed by a centrifugal force. This contributes to limiting a reduction in air blowing efficiency even when the blade 42 is deformed by a centrifugal force.

In the axial fan A having the above-described structure, the radial distance between the radially outermost portion of the blade 42 and the inner surface of the air channel wall portion 11 is arranged to be greater on a forward side of the first portion 425 of the blade 42 with respect to a rotation direction Rd of the impeller 40 than on a rearward side of the first portion 425 with respect to the rotation direction Rd.

With this arrangement, the width of a gap between the air channel wall portion 11 and a portion of the blade 42 which is prone to being deformed by a centrifugal force is made relatively large to enable the width of the gap between the blade 42 and the air channel wall portion 11 to be restricted to an appropriate range even when a centrifugal force acts on the blade 42. This contributes to limiting the reduction in the air blowing efficiency.

In the axial fan A having the above-described structure, the radial distance between the radially outermost portion of the blade 42 and the inner surface of the air channel wall portion 11 is arranged to gradually increase in a forward direction with respect to the rotation direction Rd from the first portion 425. With this arrangement, an abrupt increase in the width of the gap between the blade 42 and the air channel wall portion 11 can be avoided to prevent an abrupt change in pressure on a blade surface.

In the axial fan A having the above-described structure, a portion of the blade 42 on the rearward side of the first portion 425 with respect to the rotation direction Rd of the impeller 40 is at a greater radial distance from the inner surface of the air channel wall portion 11 than a portion of the blade 42 on the forward side of the first portion 425 with respect to the rotation direction Rd. With this arrangement, the width of a gap between the air channel wall portion 11 and a portion of the blade 42 which is prone to being deformed by a centrifugal force is made relatively large to enable the width of the gap between the blade 42 and the air channel wall portion 11 to be restricted to an appropriate range even when a centrifugal force acts on the blade 42. This contributes to limiting the reduction in the air blowing efficiency.

In the axial fan A having the above-described structure, the radial distance between the radially outermost portion of the blade 42 and the inner surface of the air channel wall portion 11 is arranged to gradually increase in a rearward direction with respect to the rotation direction Rd from the first portion 425. With this arrangement, an abrupt increase in the width of the gap between the blade 42 and the air channel wall portion 11 can be avoided to prevent an abrupt change in pressure on a blade surface.

In the axial fan A having the above-described structure, the radial distance between the radially outermost portion of the blade 42 and the inner surface of the air channel wall portion 11 is greatest at a rearward end portion of the radially outermost portion of the blade 42 with respect to the rotation direction Rd. A rearward end portion of the blade 42 is a portion where an air flow separates from the blade 42, and this separation may cause a vibration. The above arrangement allows the width of the gap between the blade 42 and the air channel wall portion 11 to be restricted to an appropriate range even when such a vibration occurs, which contributes to limiting the reduction in the air blowing efficiency.

In the axial fan A having the above-described structure, the axially projected area or the combined axially projected area of a portion or portions of the blade 42 where at least one of the inner circumferential developed blade, the outer circumferential developed blade, and the intermediate circumferential developed blade does not overlap with another one of the inner circumferential developed blade, the outer circumferential developed blade, and the intermediate circumferential developed blade when viewed in the radial direction is greater than the axially projected area of the first portion 425. In this preferred embodiment, each blade 42 has two such portions 426 and 427 where at least one of the inner circumferential developed blade, the outer circumferential developed blade, and the intermediate circumferential developed blade does not overlap with another one of the inner circumferential developed blade, the outer circumferential developed blade, and the intermediate circumferential developed blade when viewed in the radial direction, and thus, a sum of the axially projected area of the portion 426 and the axially projected area of the portion 427 is arranged to be greater than the axially projected area of the first portion 425. This arrangement enables the gap between the blade 42 and the air channel wall portion 11 to be restricted to a more appropriate range when a centrifugal force is acting on the blade 42, which contributes to limiting the reduction in the air blowing efficiency.

In the axial fan A having the above-described structure, in the outer circumferential developed blade 422, a region where the radially outermost portion of the blade 42 is at the shortest radial distance from the inner surface of the air channel wall portion 11 is arranged to have a circumferential dimension equal to or greater than a half of a circumferential dimension of the outer circumferential developed blade 422. With this arrangement, the circumferential dimension of a region where the distance between the radially outermost portion of the blade 42 and the air channel wall portion 11 is short is increased to achieve an improvement in the air blowing efficiency.

An axial fan according to a preferred embodiment of the present disclosure may be used in, for example, a blower apparatus. The blower apparatus is used, for example, to cool an electronic device.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An axial fan comprising:

a motor including a shaft extending along a central axis extending in a vertical direction;

an impeller fixed to the shaft, and capable of rotating about the central axis; and a housing including an air channel wall portion, the housing being tubular, extending in an axial direction, and radially outside of the impeller; wherein the impeller includes:

an impeller hub directly or indirectly fixed to the shaft, the impeller hub being tubular; and a plurality of blades arranged in a circumferential direction on an outer surface of the impeller hub;

each blade includes a first portion where all of an inner circumferential developed blade, an outer circumferential developed blade, and an intermediate circumferential developed blade are superimposed on each other and overlap when viewed in a radial direction, the inner circumferential developed blade being a circumferential development of a junction of the blade with the outer surface of the impeller hub, the outer circumferential developed blade being a circumferential development of a radially outermost portion of the blade, the intermediate circumferential developed blade being a circumferential development of a radially intermediate portion of the blade between the junction and the radially outermost portion of the blade;

the radially outermost portion of the blade is at a shortest radial distance from an inner surface of the air channel wall portion in at least a portion of the first portion; and a radial distance from the radially outermost portion of the blade to an inner surface of the air channel wall portion in remaining portions about a circumference of the blade which differ from the first portion is loner than the shortest radial distance.

2. The axial fan according to claim 1, wherein the radial distance between the radially outermost portion of the blade and the inner surface of the air channel wall portion is greater on a forward side of the first portion of the blade with respect to a rotation direction of the impeller than on a rearward side of the first portion with respect to the rotation direction.

3. The axial fan according to claim 2, wherein the radial distance between the radially outermost portion of the blade and the inner surface of the air channel wall portion gradually increases in a forward direction with respect to the rotation direction from the first portion.

4. The axial fan according to claim 1, wherein a portion of the blade on a rearward side of the first portion with respect to a rotation direction of the impeller is at a greater radial distance from the inner surface of the air channel wall portion than a portion of the blade on a forward side of the first portion with respect to the rotation direction.

5. The axial fan according to claim 4, wherein the radial distance between the radially outermost portion of the blade and the inner surface of the air channel wall portion gradually increases in a rearward direction with respect to the rotation direction from the first portion.

6. The axial fan according to claim 4, wherein the radial distance between the radially outermost portion of the blade and the inner surface of the air channel wall portion is greatest at a rearward end portion of the radially outermost portion of the blade with respect to the rotation direction.

7. The axial fan according to claim 4, wherein an axially projected area or a combined axially projected area of a portion or portions of the blade where at least one of the inner circumferential developed blade, the outer circumferential developed blade, and the intermediate circumferential developed blade does not overlap with another one of the inner circumferential developed blade, the outer circumferential developed blade, and the intermediate circumferential developed blade when viewed in the radial direction is greater than an axially projected area of the first portion.

8. The axial fan according to claim 4, wherein, in the outer circumferential developed blade, a region where the radially outermost portion of the blade is at the shortest radial distance from the inner surface of the air channel wall portion has a circumferential dimension equal to or greater than a half of a circumferential dimension of the outer circumferential developed blade.

9. The axial fan according to claim 1, wherein an axially projected area or a combined axially projected area of a portion or portions of the blade where at least one of the inner circumferential developed blade, the outer circumferential developed blade, and the intermediate circumferential developed blade does not overlap with another one of the inner circumferential developed blade, the outer circumferential developed blade, and the intermediate circumferential developed blade when viewed in the radial direction is greater than an axially projected area of the first portion.

10. The axial fan according to claim 1, wherein, in the outer circumferential developed blade, a region where the radially outermost portion of the blade is at the shortest radial distance from the inner surface of the air channel wall portion has a circumferential dimension equal to or greater than a half of a circumferential dimension of the outer circumferential developed blade.

* * * * *